United States Patent [19]

Lepretre et al.

[11] Patent Number: 4,586,873

[45] Date of Patent: May 6, 1986

[54] MIXER-EJECTOR WITH JET EFFECT AND VARIABLE CROSS-SECTION

[75] Inventors: Marc V. A. Lepretre, Bois-Colombes; Lucien D. Balzano, Jouars Ponchartrain; Michel R. Caillault, Orgerus, all of France

[73] Assignee: BERTIN & Cie, Plaisir, France

[21] Appl. No.: 669,861

[22] Filed: Nov. 9, 1984

[30] Foreign Application Priority Data

Nov. 10, 1983 [FR] France ..... 83 17869

[51] Int. Cl.[4] ..... F04F 5/48

[52] U.S. Cl. ..... 417/54; 417/185; 138/45; 251/5

[58] Field of Search ..... 417/54, 178, 179, 180, 417/182, 185, 193; 138/45; 251/5

[56] References Cited

U.S. PATENT DOCUMENTS

| | | | |
|---|---|---|---|
| 1,457,799 | 6/1923 | Schmidt | 417/193 |
| 2,074,480 | 3/1937 | MacLean | 417/179 X |
| 2,142,520 | 1/1939 | MacLean | 417/185 |
| 3,276,480 | 10/1966 | Kennedy | 138/45 |
| 3,791,764 | 2/1974 | Summer | 417/185 |
| 3,891,353 | 6/1975 | Templeman | 417/193 X |
| 3,942,724 | 3/1976 | Mocarski | 417/193 X |

FOREIGN PATENT DOCUMENTS

| | | | |
|---|---|---|---|
| 415379 | 6/1925 | Fed. Rep. of Germany | 417/185 |
| 1054798 | 4/1959 | Fed. Rep. of Germany | 251/5 |
| 2534983 | 4/1984 | France | 417/185 |
| 390304 | 11/1973 | U.S.S.R. | 417/182 |

*Primary Examiner*—William L. Freeh
*Assistant Examiner*—Paul F. Neils
*Attorney, Agent, or Firm*—A. W. Breiner

[57] ABSTRACT

A mixer-ejector with jet effect incorporates inductor nozzles opening into a venturi profile conduit having in succession a highly convergent suction sleeve, a coupling wall and a diffuser. The coupling wall is a variable-profile venturi part, consisting of a hollow sleeve made of a distortable elastic material in a casing with leaktight sealing and incorporates means for introducing a fluid into the enclosure formed by the sleeve and the casing.

4 Claims, 6 Drawing Figures

FLUID PRESSURE SOURCE
PRESSURE REGULATOR
PRESSURE REGULATOR
DEPRESSION SOURCE

MIXER-EJECTOR WITH JET EFFECT AND VARIABLE CROSS-SECTION

BACKGROUND OF THE INVENTION

The subject of the present invention is a mixer-ejector with jet effect and the invention can be applied in particular to the energy converters intended for the recompression of gas or wet steam.

These converters, known as "thermocompressors", are dilution devices in which an exchange of energy is produced between a driving gas (or steam) and a gas (or steam) which is drawn in.

Thermocompressors, being static devices, are very simple and reliable. They are employed particularly in evaporators in the field of agriculture and food processing for concentrating an aqueous solution and/or suspension (sugar manufacture, dairy products, distilleries, sea water desalination plants, and the like).

Originally, the use of ejectors was restricted to the construction of simple devices with a low entrainment ratio (relationship of the induced flow drawn in to the motive or inductor flow) at a low recompression ratio (relationship of the delivery pressure to the suction pressure).

In general, an ejector incorporates a motive nozzle which opens, delivering a flow Q' of steam or gas at a total pressure P' and a total temperature T', into a steam or gas suction sleeve (induced flow Q'', total pressure P'' at the total temperature T''). This sleeve is extended by a mixer in which the energy exchange between the two flows takes place and then by a diffuser which converts the resultant kinetic energy of the mixture with a flow Q, into a static pressure P at the total temperature T.

An improvement in the ejectors has been to replace the single inductor by a plurality of nozzles which, by virtue of the division of the driving jet, improves the quality of the mixing and makes it possible to increase the entrainment ratio for a given recompression ratio.

To increase the capacities of these ejectors, that is to say to increase the recompression ratio P/P'' it has been necessary to generate a supersonic mixed flow at the inlet of the mixer. As it changes to a subsonic velocity, this flow produces a shock wave. The location of this change must be chosen judiciously to avoid a loss in efficiency and even a deterioration of the equipment (ejector and even downstream receiver).

It has thus been proposed to insert a venturi between the mixer and the diffuser and to create conditions for the change from supersonic to subsonic flow to take place opposite the venturi throat.

For optimum throat dimensions (sonic throat), this arrangement makes it possible to ensure a continuous recompression without flow shock. However, this type of device presents two difficulties:

the maximum efficiency of the device corresponds to a throat diameter below the critical priming size; and the operating conditions can change with time as a function of fouling or of production requirements. The device must therefore have a fairly wide range of adaptability.

To overcome these disadvantages, a variable geometry is produced, which comprises all or a part of the converger, the throat at the outlet of this converger and at least a part of the diverger.

Under these conditions the initial priming is produced at a throat size greater than or equal to the critical size, the throat is then closed again until there is obtained the required pressure level permitting the change from supersonic flow (in the converger) to subsonic flow (in the diverger) without shock wave formation and with the losses reduced to a minimum.

The variable-profile part consists advantageously of a sleeve or flange made of a distortable eleastic material which is acted upon by a pressurized fluid driven by the upstream pressure, the suction pressure or the pressure downstream of the ejector. The distortion of the elastic wall adapts the throat to the conditions of use.

We have found, however, that the use of this external pressure to distort the elastic sleeves gives rise, if no special precaution is taken, to a creased inner cross-section with a multilobe appearance (see FIGS. 1 and 2) with more or less pronounced lobes, which is incompatible with a homogeneous aerodynamic flow.

SUMMARY OF THE INVENTION

According to the present invention, the elastic sleeve is subjected to tensile prestressing by stretching its body, before the deforming pressure is applied. It is then found that the sleeve, which no longer works in buckling as previously, but in extension, causes a distortion with a harmonious profile resembling the nozzle tube profile widely employed in aerodynamics (see FIGS. 3 and 4).

DESCRIPTION OF THE PREFERRED EMBODIMENT

Figures 1, 2, 3, 4, 5:
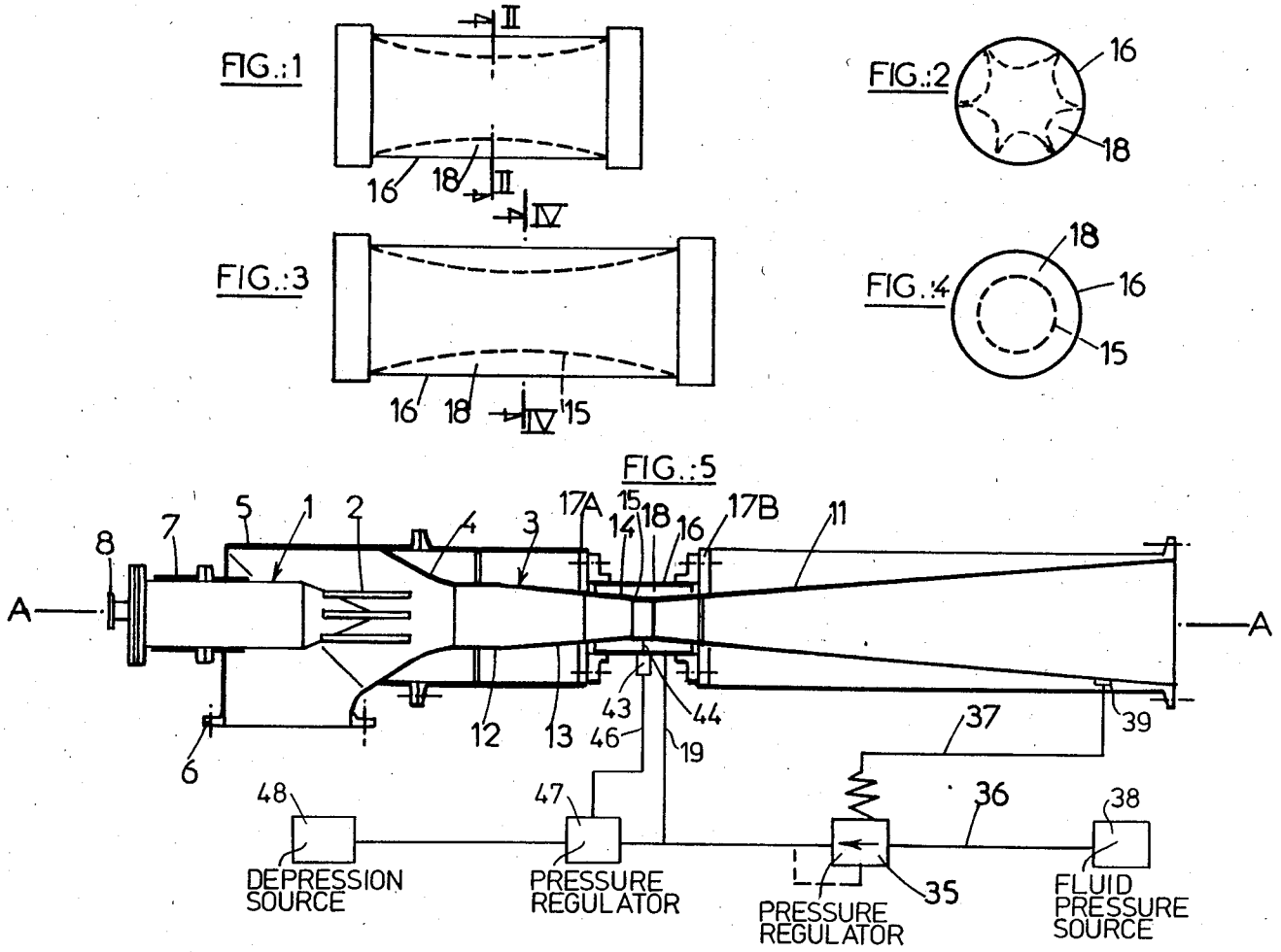
FIG. 1 is a highly diagrammatic view in axial section showing a conventional device with an elastic sleeve which can be distorted by the exertion of an external pressure of pressurized fluid.
FIG. 2 is a view in cross-section through the line II—II of FIG. 1 showing an undesirable buckled cross-section.
FIG. 3 is a view similar to FIG. 1, illustrating the principle of the present invention.
FIG. 4 is a view in cross-section through the line IV—IV of FIG. 3, showing a desirable smooth cross-section.
FIG. 5 is a diagrammatic view in longitudinal section of a mixer-ejector arranged according to the present invention.

The mixer-ejector shown in FIG. 5 incorporates a driving nozzle tube 1 consisting of a plurality of inductor nozzles 2 (in this case seven) opening into a venturi profile conduit 3 arranged along the axis A—A.

This conduit 3 incorporates upstream a suction sleeve 4 with a highly convergent profile enclosing the driving nozzle tube1. The upstream end of this sleeve is in contact with a hollow body 5 which can be coupled at 6 to a pipeline conveying the induced flow, of wet steam, for example.

The nozzles 2 are fixed to a conduit 7 by which they are supplied with the inductor fluid, the said conduit being coupled for this purpose, by means of a strainer 8 if appropriate, to a pipework for delivery of the inductor fluid, of live steam, for example.

Downstream of the conduit 3, the diffuser consists of a diverger 11 which can be coupled to the user device.

The coupling wall, between the suction sleeve 4 and the diffuser 11, incorporates a substantially cylindrical part 12 followed by a part 13 with slight convergent conicity and finally by a variable profile part 14.

This profile 14 consists (FIG. 6) of a sleeve 15 made of distortable elastic material (natural or synthetic rubber, elastomer), housed in a cylindrical casing 16 inserted, with leaktight sealing, between adjacent flanges 17 A and 17 B. The enclosure 18 thus formed is supplied with pressurized fluid by means 19 (pipework).

The sleeve 15 is extended on either side by two annular collars 21 and 22 forming an integrating part of the sleeve.

The supply of pressurized fluid to the enclosure 18 is provided by a pressure regulator 35 coupled to a source of fluid (preferably liquid) pressure 38 by the pipework 36 on the one hand and to the means 19 on the other hand. This regulator 35 is controlled by the upstream driving pressure, the suction pressure or the downstream delivery pressure of the ejector by virtue of the conduit 37 coupled to a pressure take-off 39 arranged in the suction sleeve 4, the mixer or the diffuser 11.

Figure 6:
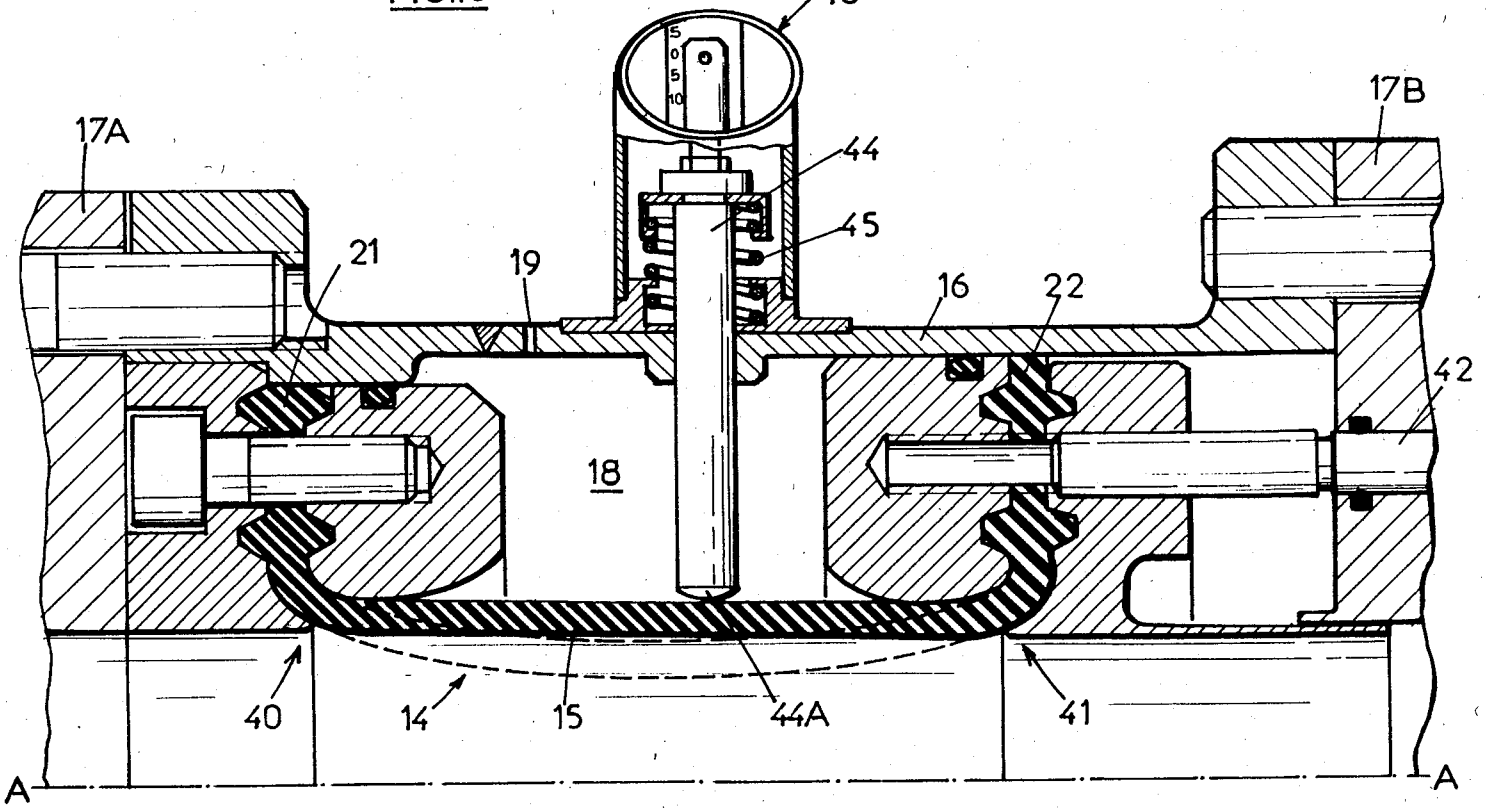
FIG. 6 is a view in axial half-section on a larger scale illustrating a preferred embodiment of the present invention.

A change in the upstream, suction or downstream reference pressure produces actuation of the regulator 35 which acts on the delivery of the fluid into the enclosure 18, resulting in a change in the inner profile of the sleeve 15, which changes, for example, from the position shown by continuous lines in FIG. 6 to the position shown in dot-and-dash lines.

Returning to the preferred embodiment of the present invention, shown in FIG. 6, it will be noted that one of the end collars, for example that on the left, indicated by 21, is firmly locked in a fixed jaw 40 fixed integrally to the casing 16, while the opposite end collar 22 is firmly held in a movable jaw 41 sliding axially in the casing 16 under the effect of a jack (not shown) the stem of which is shown at 42 and which may be a screw jack.

According to the present invention, before the enclosure 18 surrounding the elastic sleeve 15 is pressurized, the latter is stretched by moving the movable jaw 41 to the right of the drawing by means of the jack 42, thus imparting a tensile prestressing to the sleeve 15.

Now, it can be observed that, initially, during this stretching, a narrowing in the cross-section at the mid-length of the sleeve 15 is produced, which may be unfavorable for the initial flow of the fluid in the latter. This state of affairs is overcome by the reduction in pressure in the outer enclosure 18 by connecting the channel 19 to a vacuum source (not shown). The cylindrical profile of the sleeve 15 is thus restored.

In operation, overpressure is restored in the enclosure 18 to obtain the venturi profile with the required sonic throat.

All these maneuvers can be produced automatically by controlling, with the aid of a suitable detector, the cross-section of the throat of the elastic sleeve 15. In FIG. 6, 43 represents such a detector, showing at 44 a radial feeler finger stressed by a spring 45 in order that its lower end 44 A remains in continuous contact with the outer surface of the elastic sleeve 15 in the vicinity of its mid-length.

The detector 43, in response to the position of finger 44 emits electrical signals which are transmitted through a line 46 to pressure regulator 47, which is coupled to a depression source 48 and to the means 19 for supplying the enclosure 18.

We claim:

1. Process for employing a mixer-ejector with jet effect of the type incorporating at least one inductor nozzle opening into a venturi conduit incorporating, in succession, a highly convergent suction sleeve, in contact with a hollow body which can be coupled to a pipeline conveying an induced flow, an intermediate, variable-profile venturi part consisting of a sleeve made of distortable elastic material housed with leaktight sealing in a casing which forms with the sleeve an enclosure surrounding the latter, and a diffuser which can be coupled to a user device, wherein the improvement comprising, in the operation of the mixer-ejector, the steps of subjecting the elastic sleeve to a tensile prestressing by stretching its body in a direction parallel to the axis of said sleeve before applying to the enclosure a pressure higher than in said venturi conduit to impart to said body the desired venturi profile.

2. Process as claimed in claim 1, wherein, while the elastic sleeve has a quasi-cylindrical profile at rest, the enclosure is subjected to a reduced pressure at the outset to preserve this quasi-cylindrical profile notwithstanding the stretching of the sleeve, after which, during operation, overpressure is again applied to the enclosure to produce the desired venturi profile.

3. Process as claimed in claim 1, wherein one of the ends of the elastic sleeve is locked in position, the stretching being carried out by moving away its other end.

4. Process as claimed in claim 1, wherein the pressure in the enclosure is controlled starting from a detection of the cross-section of the body of the elastic sleeve at approximately mid-length of the latter.

* * * * *